US009145718B1

(12) United States Patent
Lin

(10) Patent No.: US 9,145,718 B1
(45) Date of Patent: Sep. 29, 2015

(54) LATCH ASSEMBLY WITH AN ANTI-PICKING FUNCTION

(71) Applicant: I-TEK METAL MFG. CO., LTD., Tainan (TW)

(72) Inventor: Hsi-Ting Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 53 days.

(21) Appl. No.: 14/258,080

(22) Filed: Apr. 22, 2014

(51) Int. Cl.
*E05B 65/10* (2006.01)
*E05C 1/00* (2006.01)

(52) U.S. Cl.
CPC ..... *E05C 1/004* (2013.01); *E05B 65/1006* (2013.01); *E05B 65/1066* (2013.01)

(58) Field of Classification Search
CPC ..... E05C 1/004; E05C 1/00; E05C 1/02; E05C 1/04; E05C 1/06; E05C 1/065; E05C 1/08; E05C 1/10; E05C 1/12; E05C 1/14; E05C 1/145; E05C 1/16; E05C 1/163; Y10S 292/60
USPC ..... 292/161, 143, 160, 157, 2, 139, 292/DIG. 21, DIG. 46, 137, 138, 163, 173, 292/166, 168, 332–336
See application file for complete search history.

(56) References Cited

U.S. PATENT DOCUMENTS 2,908,523 A * 10/1959 Foster ..... 292/333
6,009,732 A * 1/2000 Haeck et al. ..... 70/92
2007/0029812 A1* 2/2007 Monts de Oca ..... 292/137

* cited by examiner

*Primary Examiner* — Kristina Fulton
*Assistant Examiner* — Thomas Neubauer
(74) *Attorney, Agent, or Firm* — Alan D. Kamrath; Kamrath IP Lawfirm, P.A.

(57) ABSTRACT

A latch assembly with an anti-picking function includes a bracket mounted in a door and located at a top or bottom end of the door. A movable member is slideably received in the bracket. A lever is pivotably mounted in the bracket. A positioning member includes a first pivotal portion pivotably connected to the movable member. The positioning member and the movable member can move jointly. The positioning member further includes a second pivotal portion pivotably connected to the lever. When the lever pivots, the positioning member pivots and actuates the movable member to move, causing movement of a latch between a latching position and an unlatching position. When the latch is in the latching position, a lug of the positioning member abuts against the movable member to prevent the latch from moving from the latching position to the unlatching position by picking.

5 Claims, 5 Drawing Sheets

LATCH ASSEMBLY WITH AN ANTI-PICKING FUNCTION

BACKGROUND OF THE INVENTION

The present invention relates to a latch assembly and, more particularly, to a latch assembly to be mounted to a top end or a bottom end of a door for reliably fixing the door in a door frame without the risk of picking.

A type of latch assembly is mounted to a top or bottom end of a door and includes a latch extending into a door frame when the door is in a closed position to prevent opening of the door. Such a latch assembly can only be opened from the inside of the door to provide enhanced burglarproof effect. A gap exists between the top face of the door and the door frame or between the bottom face of the door and the ground to allow smooth opening of the door by avoiding friction between the door and the door frame or the ground. A burglar can pick the latch via the gap and, thus, open the door.

Thus, a need exists for an anti-pick latch assembly to prevent unauthorized opening of the door.

BRIEF SUMMARY OF THE INVENTION

The present invention solves this need and other problems in the field of anti-picking are solved by providing a latch assembly including a bracket having two lateral sides spaced from each other in a direction perpendicular to a longitudinal axis of the bracket. The bracket further includes a connecting section extending between the two lateral sides. The connecting section includes an opening between the lateral sides. Each of lateral side includes a first track groove and a second track groove spaced from the first track grove along the longitudinal axis of the bracket. The bracket is adapted to be fixed to a lateral face of a door. The lateral sides are adapted to be received in a mounting space of the door.

A movable member is mounted between the lateral sides of the bracket and is movable along the longitudinal axis of the bracket. The movable member includes two sidewalls and an intermediate wall extending between the sidewalls. The intermediate wall includes an opening. Each sidewall includes first, second, and third holes, with the third hole located between the first and second holes. Each first hole is aligned with the first track grooves of the lateral sides of the bracket. Each second hole is aligned with the second track grooves of the lateral sides of the bracket.

A first pin slideably extends through the first track grooves of the lateral sides of the bracket and extends through the first holes of the sidewalls of the movable member. A second pin slideably extends through the second track grooves of the lateral sides of the bracket and extends through the second holes of the sidewalls of the movable member. A latch is fixed to movable member. The latch and the movable member are jointly movable along the longitudinal axis of the bracket between a latching position and an unlatching position. A lever includes a driving end, a follower end, and a pivotal portion located between the driving end and the follower end. The pivotal portion is pivotably connected to the bracket.

A positioning member is received between the sidewalls of the movable member and is aligned with the opening of the movable member. The positioning member includes a first pivotal portion pivotably connected to the third holes of the sidewalls of the movable member. The positioning member further includes a second pivotal portion pivotably connected to the follower end of the lever. The positioning member further includes a lug adjacent to the second pivotal portion.

When the latch is in the unlatching position, the latch is adapted to be received in the mounting space of the door, and the lug of the positioning member abuts the sidewalls of the movable member.

On the other hand, when the latch is in the latching position, the latch is adapted to extend outside of the mounting space of the door, the lug of the positioning member abuts the sidewalls of the movable member, and the second pivotal portion of the positioning member is located between the first pivotal portion of the positioning member and the connecting section of the bracket.

When the lever pivots to move the latch from the latching position to the unlatching position or from the unlatching position to the latching position, the lug of the positioning member moves away from the sidewalls of the movable member.

When the latch is in the latching position, if the latch is picked to move from the latching position to the unlatching position, the lug of the positioning member is stopped by the sidewalls of the movable member to prevent the latch from moving from the latching position to the unlatching position.

In an embodiment, a spring is mounted between the sidewalls of the movable member. The positioning member includes two side sections and a connecting section extending between the side sections and having a retaining groove. The spring includes a first tang abutting against the first pin and a second tang abutting against a wall of the retaining groove. The spring biases the latch to one of the latching position and the unlatching position. The first pivotal portion of the positioning member is pivotably connected the third holes of the sidewalls of the movable member by an axle. The spring is mounted around the axle.

In an embodiment, each sidewall of the movable member includes an engagement groove adjacent to the intermediate wall. The lug of the positioning member is received in the engagement grooves of the sidewalls of the movable member when the latch is in one of the latching position and the unlatching position. When the lever pivots to move the latch from the latching position to the unlatching position or from the unlatching position to the latching position, the lug of the positioning member disengages from the engagement grooves of the sidewalls of the movable member.

In an embodiment, the pivotal portion of the lever is pivotably connected to the bracket by a third pin. The second pivotal portion of the positioning member is pivotably connected to the follower end of the lever by a fourth pin. A spacing between a pivot axis defined by the third pin and a pivot axis defined by the fourth pin is larger than a spacing between the pivot axis defined by the third pin and the intermediate wall of the movable member when the lever is in a position corresponding to the latching position or the unlatching position of the latch.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
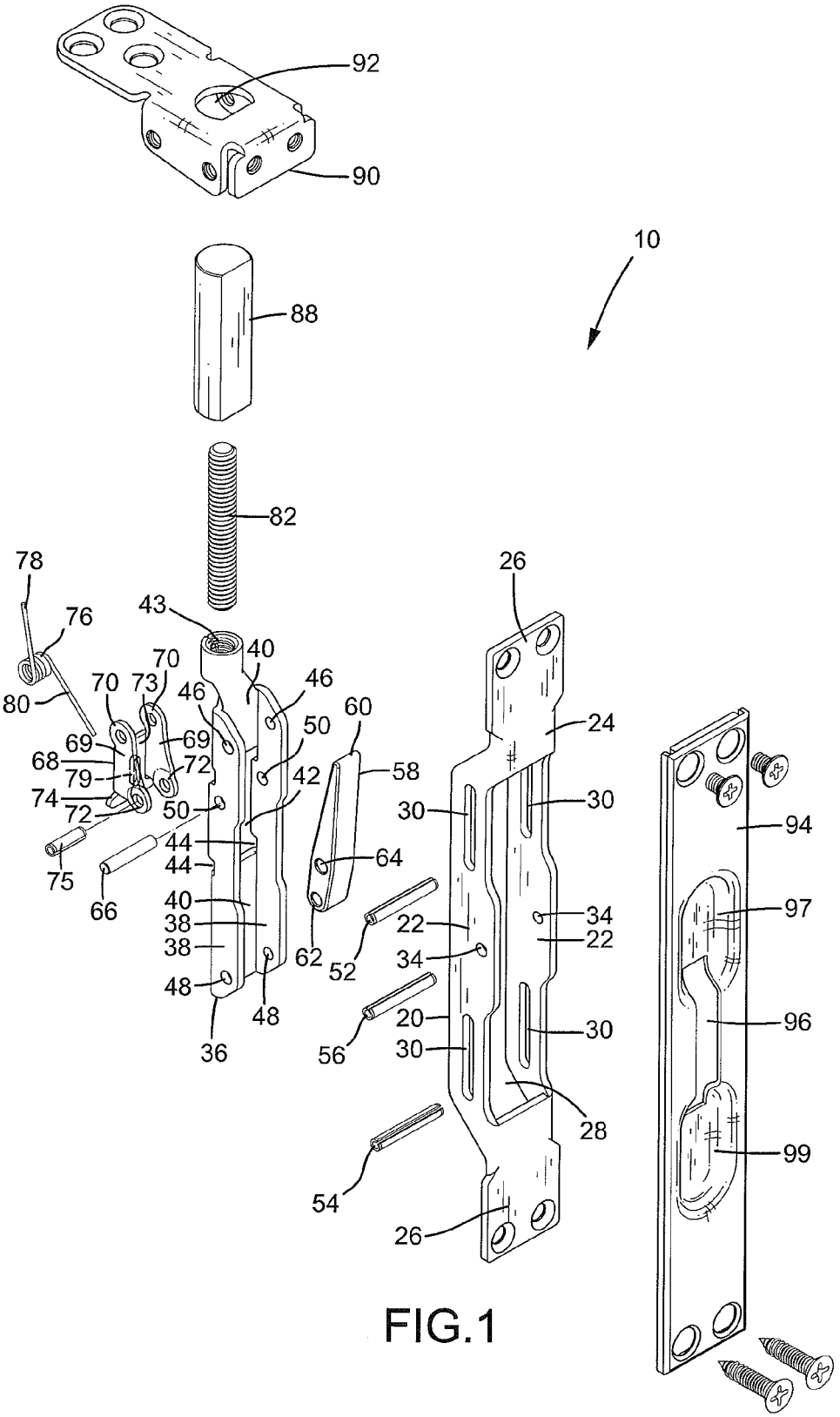
FIG. 1 is an exploded, perspective view of a latch assembly with an anti-picking function according to the present invention.
Figure 2:
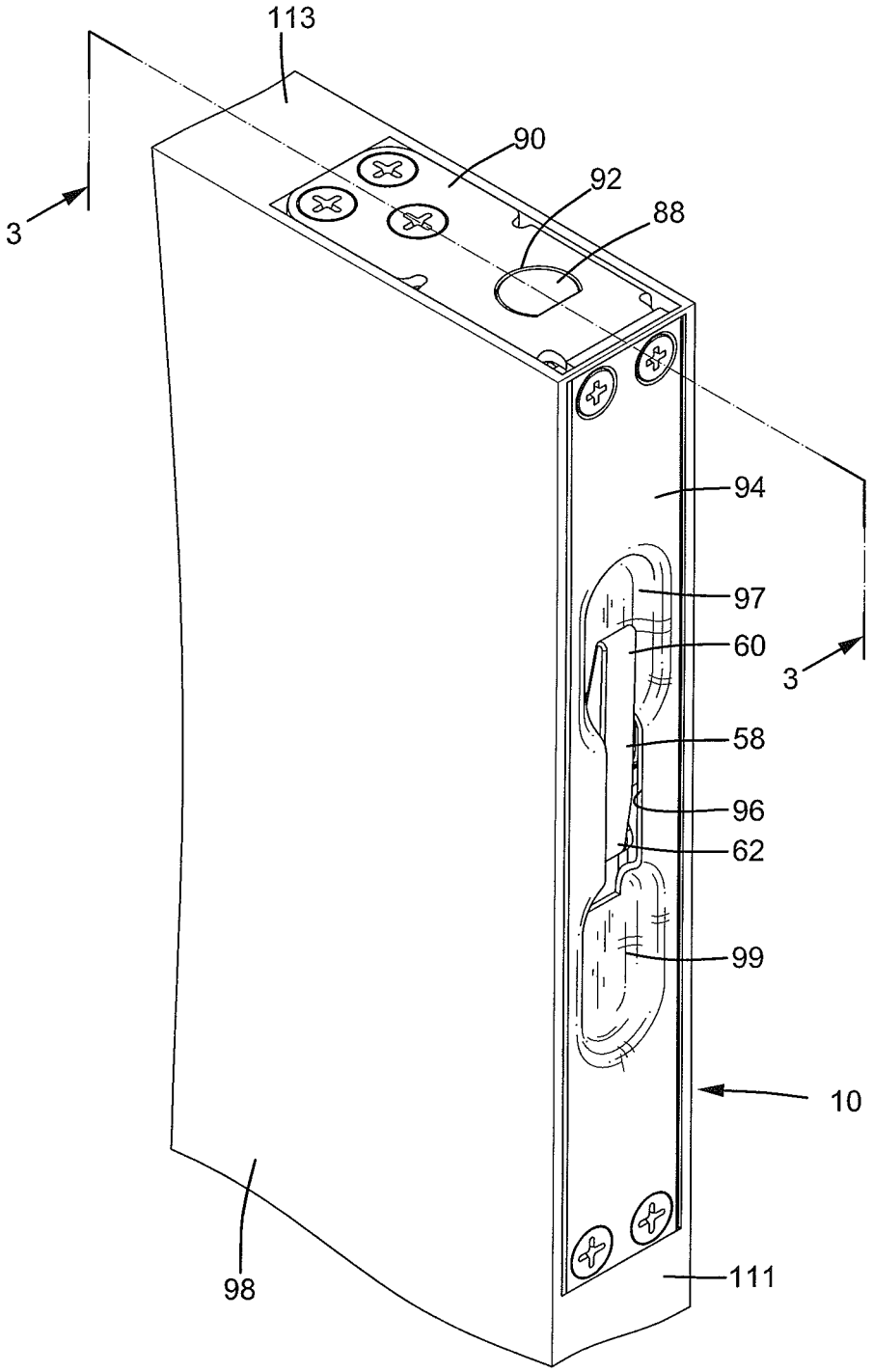
FIG. 2 is a perspective view of a portion of a door and the latch assembly of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "lateral", "outward", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A latch assembly 10 with an anti-picking function according to the present invention is shown in the drawings and includes a bracket 20 having two lateral sides 22 parallel to each other. Lateral sides 22 are spaced from each other in a direction perpendicular to a longitudinal axis of bracket 20. Each lateral side 22 includes first and second faces opposite to each other. Bracket 20 further includes a connecting section 24 extending between lateral sides 22. Connecting section 24 includes an opening 28 between lateral sides 22. Opening 28 divides connection section 24 into two portions. Connecting section 24 further includes a wing 26 extending outward from each portion. Each lateral side 22 includes two track grooves 30 extending from the first face thereof through the second face thereof. Each lateral side 22 further includes a pin hole 34 extending from the first face thereof through the second face thereof and located between the track grooves 30. In the form shown, track grooves 30 on each lateral side 22 are aligned with and spaced from each other along the longitudinal axis of bracket 20.

According to the form shown, latch assembly 10 further includes a movable member 36 slideably received between lateral sides 22 of bracket 20. Movable member 36 includes two sidewalls 38 spaced from and parallel to each other. Movable member 36 further includes an intermediate wall 40 extending between sidewalls 38. Intermediate wall 40 includes an opening 42 between sidewalls 38. Each sidewall 38 includes an engagement groove 44 in communication with opening 42. Each sidewall 38 further includes a first hole 46, a second hole 48 spaced from first hole 46 along the longitudinal axis of bracket 20, and a third hole 50 between first and second holes 46 and 48. Opening 42 is located between first and second holes 46 and 48 of each sidewall 38. Each engagement groove 44 is located between second and third holes 48 and 50 of each sidewall 38. Movable member 36 further includes an engagement portion 43 extending from an end of intermediate wall 40 and having a screw hole. Each first hole 46 of each sidewall 38 is aligned with one of track grooves 30 of each lateral side 22 of bracket 20. Each second hole 48 of each sidewall 38 is aligned with the other track groove 30 of each lateral side 22 of bracket 20. Intermediate wall 40 of movable member 36 faces connecting section 24 of bracket 20.

According to the form shown, a first pin 52 slideably extends through one of track grooves 30 of each lateral side 22 of bracket 20 and extends through first hole 46 in each sidewall 38 of movable member 36. A second pin 54 slideably extends through the other track groove 30 of each lateral side 22 of bracket 20 and extends through second hole 48 in each sidewall 38 of movable member 36. Thus, first and second pins 52 and 54 and movable member 36 can jointly move along the longitudinal axis of bracket 20 in a range delimited by a length of each track groove 30 along the longitudinal axis of bracket 20, with first and second pins 52 and 54 keeping intermediate wall 40 of movable member 36 to be parallel to connecting section 24 of bracket 20.

According to the form shown, latch assembly 10 further includes a lever 58 pivotably connected to bracket 20. Specifically, lever 58 includes a driving end 60, a follower end 62, and a pivotal portion 64 located between driving end 60 and follower end 62 and located adjacent to follower end 62. Lever 58 is received between lateral sides 22 of bracket 20 with pivotal portion 64 aligned with pin hole 34 of each lateral side 22 of bracket 20. A third pin 56 extends through pin hole 34 of each lateral side 22 of bracket 20 and pivotal portion 64 of lever 58, allowing lever 58 to pivot about a pivot axis defined by third pin 56. Opening 42 of movable member 36 provides room for pivotal movement of follower end 62 of lever 58.

According to the form shown, latch assembly 10 further includes a positioning member 68 pivotably connected to movable member 36. Positioning member 68 and movable member 36 can move jointly. Positioning member 68 includes two side sections 69 parallel to and spaced from each other. Positioning member 68 further includes a connecting section 73 extending between side sections 69 and having a retaining groove 79. Each side section 69 includes a first pivotal portion 70 on an end thereof and a second pivotal portion 72 on the other end thereof. Connecting section 73 includes a lug 74 adjacent to second pivotal portion 72 of each side section 69. Positioning member 68 is received between sidewalls 38 of movable member 36 with first pivotal portions 70 of side sections 69 aligned with third holes 50 of sidewalls 38 of movable member 36. An axle 66 extends through third holes 50 of sidewalls 38 of movable member 36 and first pivotal portions 70 of side sections 69 of positioning member 68, allowing positioning member 68 to pivot about a pivot axis defined by axle 66. Furthermore, follower end 62 of lever 58 is located between side sections 69 of positioning member 68. A fourth pin 75 extends through second pivotal portions 72 of side sections 69 of positioning member 68 and follower end 62 of lever 58, allowing lever 58 and positioning member 68 to pivot about a pivot axis defined by fourth pin 75. A spacing S1 between the pivot axis defined by third pin 56 and the pivot axis defined by fourth pin 75 is larger than a spacing S2 between the pivot axis defined by third pin 56 and intermediate wall 40 when lever 58 is in a position corresponding to the unlatching position of latch 88. When lever 58 pivots, positioning member 68 is actuated to pivot and to move together with movable member 36 along track grooves 30 of bracket 20.

Figure 3:
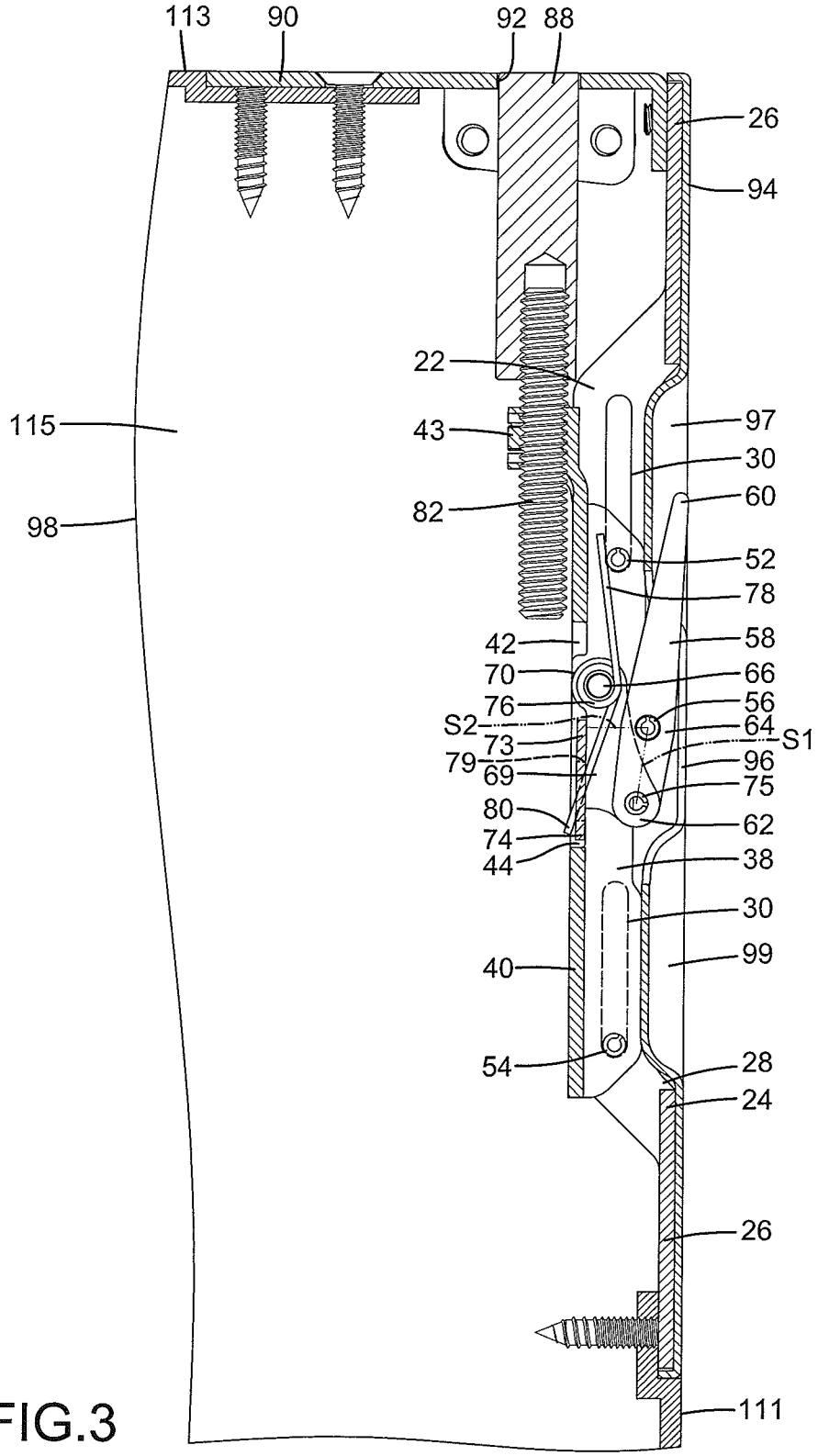
FIG. 3 is a cross sectional view taken along section line 3-3 of FIG. 2.

According to the form shown, latch assembly 10 further includes a connecting rod 82 having an outer thread. Connecting rod 82 is in threading connection with engagement portion 43 of movable member 36. A latch 88 is mounted to an end of connecting rod 82. Thus, connecting rod 82, latch 88 and movable member 36 move jointly, allowing latch 88 to move between a latching position (FIG. 5) and an unlatching position (FIG. 3).

According to the form shown, a spring 76 mounted around axle 66 and between side sections 69. Spring 76 includes a first tang 78 abutting against first pin 52 and a second tang 80 extending through retaining groove 79 and abutting against a wall of retaining groove 79.

According to the form shown, latch assembly 10 further includes an escutcheon 94 and a faceplate 90. The escutcheon 94 is fixed to an outer side of connecting section 24 of bracket 20. Escutcheon 94 includes a slot 96 aligned with opening 28 of bracket 20. Escutcheon 94 further includes a first recessed portion 97 and a second recessed portion 99 on opposite sides of slot 96. First and second recessed portions 97 and 99 are located in opening 28 of bracket 20. Slot 96 provides room for pivotal movement of lever 58. Faceplate 90 is fixed to an inner side of one of wings 26 of bracket 20 and is located outside of lateral sides 22 of bracket 20. Faceplate 90 further includes a through-hole 92 through which latch 88 extends.

Latch assembly 10 is mounted to a top end or a bottom end of a door 98. In the form shown, latch assembly 10 is mounted to the top end of door 98. Door 98 is pivotably mounted to a door frame 119 and is pivotable between a closed position (FIG. 5) and an open position. Door 98 includes top and bottom faces 113 and a lateral face 111 extending between top and bottom faces 113. Door 98 further includes a mounting space 115 therein. Mounting space 115 has an opening in lateral face 111. Latch assembly 10 is fixed to lateral face 111 by fasteners extending through the other wing 26 of bracket 20. Lateral sides 22 of bracket 20 are located in mounting space 115 of door 98. Faceplate 90 is fixed to top face 113 of door 98. Door frame 119 includes a latch hole 131 facing top face 113.

Now that the basic construction of latch assembly 10 of the present invention has been explained, the operation and some of the advantages of latch assembly 10 can be set forth and appreciated. In particular, for the sake of explanation, it will be assumed that door 98 is in the open position, and latch 88 is in the unlatching position (FIG. 3). Latch 88 is not aligned with latch hole 131 in door frame 119. In this state, driving end 60 of lever 58 is received in first recessed portion 97 of escutcheon 94. Lug 74 of positioning member 68 is received in engagement grooves 44 of movable member 36. Door 98 can pivot between the open position and the closed position. Spring 76 biases latch 88 to the unlatching position and retains latch 88 in the unlatching position.

Figure 4:
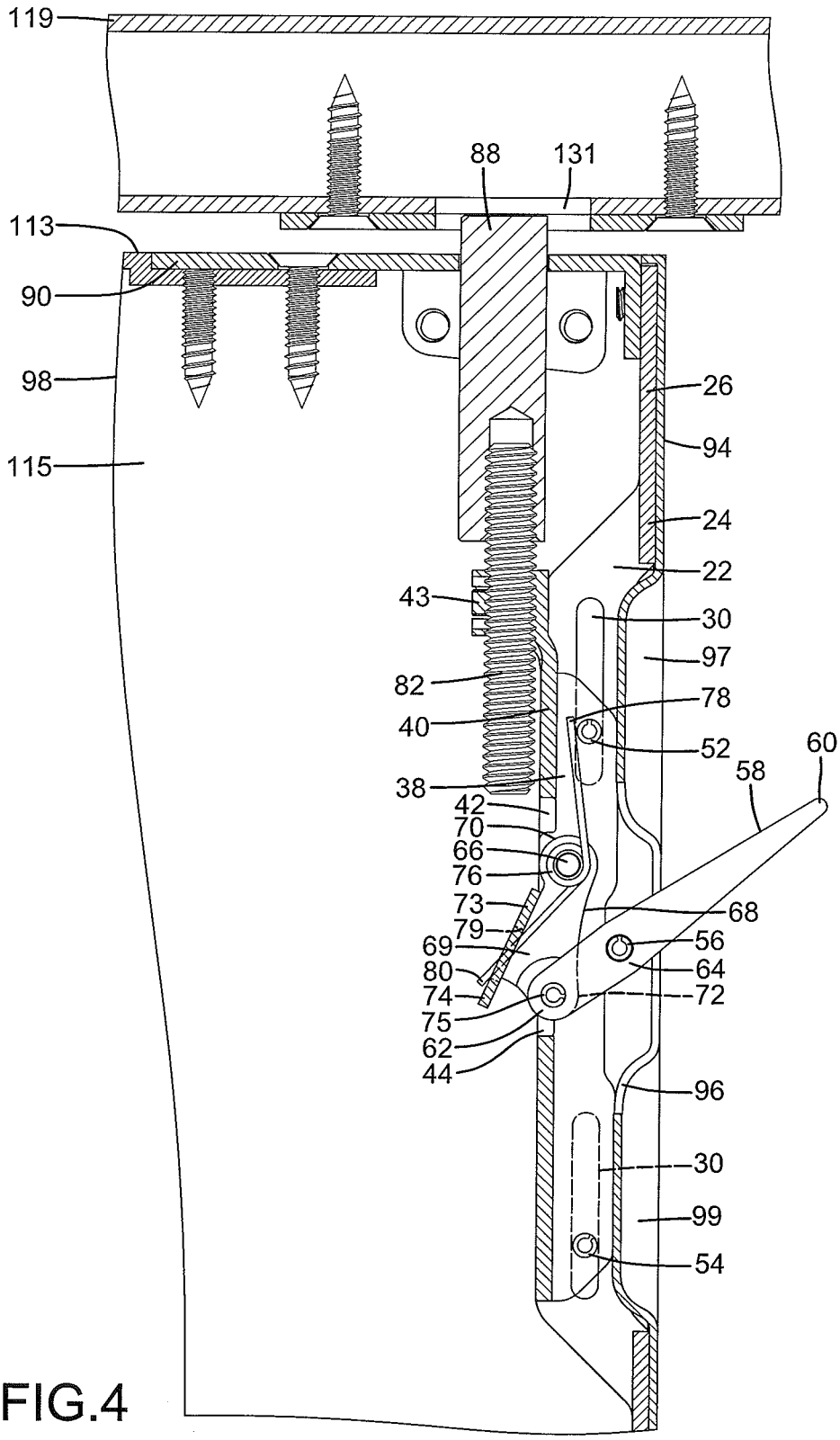
FIG. 4 is a view similar to FIG. 3 with a lever pivoted downward from a first recessed portion to a second recessed portion and with a latch is moving from an unlatching position to a latching position.

After door 98 has been moved to the closed position in which latch 88 is aligned with latch hole 131 of door frame 119, if driving end 60 of lever 58 is pivoted from first recessed portion 97 of escutcheon 94 to second recessed portion 99 of escutcheon 94, the wall of retaining groove 79 presses against second tang 80 of spring 76 and, thus, twists spring 76. Since the spacing S1 between the pivot axis defined by third pin 56 and the pivot axis defined by fourth pin 75 is larger than the spacing S2 between the pivot axis defined by third pin 56 and intermediate wall 40, lug 74 of positioning member 68 moves way from engagement grooves 44 of movable member 36 when driving end 60 of lever 58 moves from first recessed portion 97 to the second recessed portion 99. After lug 74 of positioning member 68 has disengaged from engagement grooves 44 of movable member 36 (FIG. 4), movement of positioning member 68 causes axle 66 to actuate movable member 36, connecting rod 82, and latch 88 to move along the longitudinal axis of bracket 20 (first pin 52 moves in corresponding track grooves 30 of bracket 20), moving latch 88 from the unlatching position to the latching position beyond top face 113 of door 98.

Figure 5:
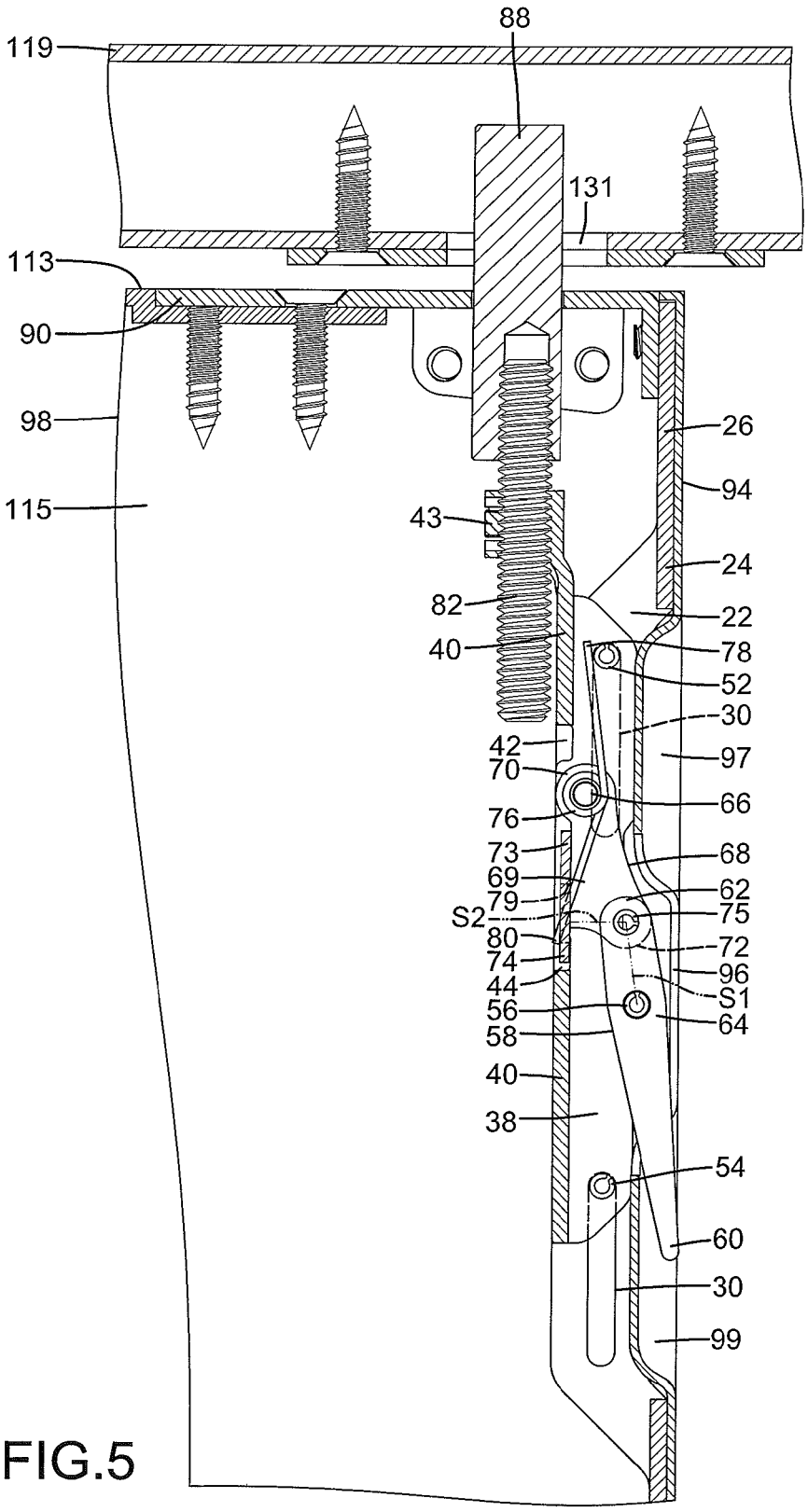
FIG. 5 is a view similar to FIG. 4 with the lever pivoted to the second recessed portion and with a latch moved to a latching position.

When driving end 60 of lever 58 reaches second recessed portion 99 of escutcheon 94, latch 88 is in the latching position (FIG. 5). Lug 74 of positioning member 68 is received in engagement grooves 44 of movable member 36. Spring 76 biases latch 88 to the latching position and retains latch 88 in the latching position. Latch 88 extends into latch hole 131 in door frame 119, preventing door 98 from moving from the closed position to the open position.

When latch 88 is in the latching position, each second pivotal portion 72 of positioning member 68 is located between each first pivotal portion 70 and connecting section 24 of bracket 20. Thus, if a burglar intends to pick latch 88 by extending a flat tool through a gap between door frame 119 and top face 113 of door 98, movement of latch 88 towards the latching position causes lug 74 of positioning member 68 to press against and is stopped by a bottom face of each engagement groove 44 of movable member 36. Namely, positioning member 68 can not pivot such that movable member 36 can not move. As a result, latch 88 retains in the latching position. Note that spacing S1 between the pivot axis defined by third pin 56 and the pivot axis defined by fourth pin 75 is larger than spacing S2 between the pivot axis defined by third pin 56 and intermediate wall 40 of movable member 36 when lever 58 is in the position corresponding to the latching position of latch 88.

When driving end 60 of lever 58 is moved from second recessed portion 99 to first recessed portion 97, lever 58 actuates lug 74 of positioning member 68 to move away from engagement grooves 44 of movable member 36. Thus, lug 74 of positioning member 68 disengages from engagement grooves 44, and movable member 36 is moved along the longitudinal axis of bracket 20 (first pin 52 moves in corresponding track grooves 30 of bracket 20), moving latch 88 from the latching position to the unlatching position.

Latch assembly 10 uses the pivoting direction of positioning member 68 to control movement of latch 88 from the latching position to the unlatching position. The mechanism is simple and effective, avoiding latch 88 from being picked while latch 88 is in the latching position, enhancing the burglarproof effect of latch assembly 10.

Now that the basic teachings of the present invention have been explained, many extensions and variations will be obvious to one having ordinary skill in the art. For example, movable member 36 does not have to include engagement grooves 44. In this case, when latch 88 is in the latching position or the unlatching position, lug 74 of positioning member 68 can abut against intermediate wall 40 or one of sidewalls 38 of movable member 36 to assure that second pivotal portion 72 of each side section 69 of positioning member 68 is located between first pivotal portion 70 of each side section 69 of positioning member 68 and connecting section 24 of bracket 20 when latch 88 is in the latching position. Thus, the anti-picking effect can be achieved even if lug 74 is not engaged in engagement grooves 44 of positioning member 68. Furthermore, each lateral side 22 of bracket 20 can include only one track groove 30 if the length of the track groove 30 is long enough to allow the travel of first and second pins 52 and 54 moving jointly with movable member 36. In this case, first and second pins 52 and 54 extending through the single track groove 30 of each lateral side 22 of bracket 20 can maintain the parallel relation between intermediate wall 40 of movable member 36 and connecting section 24 of bracket 20. Furthermore, positioning member 68 can include only one side section 69, and the lug 74 can be formed on the side section 69.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly comprising: a bracket including two lateral sides spaced from each other in a direction perpendicular to a longitudinal axis of the bracket, with the bracket further including a connecting section extending between the two lateral sides, with the connecting section including an opening between the two lateral sides, with each of the two lateral sides including a first track groove and a second track groove spaced from the first track grove along the longitudinal axis of the bracket, with the bracket adapted to be fixed to a lateral face of a door, and with the two lateral sides adapted to be received in a mounting space of the door; a movable member mounted between the two lateral sides of the bracket and linearly slidable along the longitudinal axis of the bracket, with the linearly slidable member including two sidewalls and an intermediate wall extending between the two sidewalls, with the intermediate wall including an opening, with each of the two sidewalls including first, second, and third holes, with the third hole located between the first and second holes, with each first hole aligned with the first track grooves of the two lateral sides of the bracket, and with each second hole aligned with the second track grooves of the two lateral sides of the bracket; a first pin slideably extending through the first track grooves of the two lateral sides of the bracket and extending through the first holes of the two sidewalls of the linearly slidable member;

a second pin slideably extending through the second track grooves of the two lateral sides of the bracket and extending through the second holes of the two sidewalls of the linearly slidable member; a latch fixed to linearly slidable member, with the latch and the linearly slidable member jointly linearly slidable along the longitudinal axis of the bracket between a latching position and an unlatching position; a lever including a driving end, a follower end, and a pivotal portion located between the driving end and the follower end, with the pivotal portion pivotably connected to the bracket; and a positioning member received between the two sidewalls of the linearly slidable member and aligned with the opening of the linearly slidable member, with the positioning member including a first pivotal portion pivotably connected to the third holes of the two sidewalls of the linearly slidable member, with the positioning member further including a second pivotal portion pivotably connected to the follower end of the lever, with the positioning member further including a lug adjacent to the second pivotal portion, wherein when the latch is in the unlatching position, the latch is adapted to be received in the mounting space of the door, and the lug of the positioning member abuts the two sidewalls of the movable member, wherein when the latch is in the latching position, the latch is adapted to extend outside of the mounting space of the door, the lug of the positioning member abuts the two sidewalls of the movable member, and the second pivotal portion of the positioning member is located between the first pivotal portion of the positioning member and the connecting section of the bracket, wherein when the lever pivots to move the latch from the latching position to the unlatching position or from the unlatching position to the latching position, the lug of the positioning member moves away from the two sidewalls of the linearly slidable member, and wherein when the latch is in the latching position, if the latch is picked to move from the latching position to the unlatching position, the lug of the positioning member is stopped by the two sidewalls of the linearly slidable member to prevent the latch from moving from the latching position to the unlatching position.

2. The latch assembly as claimed in claim 1, further comprising: a spring mounted between the two sidewalls of the linearly slidable member, with the positioning member including two side sections and a connecting section extending between the two side sections and having a retaining groove, with the spring including a first tang abutting against the first pin and a second tang abutting against a wall of the retaining groove, and with the spring biasing the latch to one of the latching position and the unlatching position.

3. The latch assembly as claimed in claim 2, with the first pivotal portion of the positioning member pivotably connected the third holes of the two sidewalls of the linearly slidable member by an axle, and with the spring mounted around the axle.

4. The latch assembly as claimed in claim 1, with each of the two sidewalls of the linearly slidable member including an engagement groove adjacent to the intermediate wall, wherein the lug of the positioning member is received in the engagement grooves of the two sidewalls of the linearly slidable member when the latch is in one of the latching position and the unlatching position, and wherein when the lever pivots to move the latch from the latching position to the unlatching position or from the unlatching position to the latching position, the lug of the positioning member disengages from the engagement grooves of the two sidewalls of the linearly slidable member.

5. The latch assembly as claimed in claim 1, with the pivotal portion of the lever pivotably connected to the bracket by a third pin, with the second pivotal portion of the positioning member pivotably connected to the follower end of the lever by a fourth pin, with a spacing between a pivot axis defined by the third pin and a pivot axis defined by the fourth pin being larger than a spacing between the pivot axis defined by the third pin and the intermediate wall of the linearly slidable member when the lever is in a position corresponding to the latching position or the unlatching position of the latch.

* * * * *